United States Patent [19]

Nichols

[11] Patent Number: 4,746,053

[45] Date of Patent: May 24, 1988

[54] INTERIORLY LOCKED PARTITION ASSEMBLY

[75] Inventor: Glenn R. Nichols, Wyoming, Mich.

[73] Assignee: Bradford Company, Holland, Mich.

[21] Appl. No.: 36,907

[22] Filed: Apr. 9, 1987

[51] Int. Cl.[4] ..... B65D 5/48

[52] U.S. Cl. ..... 229/120.36; 217/30; 217/32

[58] Field of Search ..... 229/15, 27, 42, 120.36; 217/30–32

[56] References Cited

U.S. PATENT DOCUMENTS

| | | | |
|---|---|---|---|
| 152,432 | 6/1874 | Strong | 217/32 |
| 201,568 | 3/1878 | Stevens | 217/30 |
| 347,835 | 8/1886 | Shibley | 217/32 |
| 1,186,967 | 6/1916 | Brown | 217/31 |
| 1,307,621 | 6/1919 | Davidson | 217/32 |
| 2,410,486 | 11/1946 | Evans | 229/42 |
| 2,549,799 | 4/1951 | George | 229/42 |
| 2,549,801 | 4/1951 | George | 229/42 |
| 2,778,522 | 1/1957 | Berke | 229/15 |
| 3,199,759 | 8/1965 | Hickin | 229/15 |
| 3,253,763 | 5/1966 | Henderson | 229/15 |
| 3,767,106 | 10/1973 | Morgan | 217/32 |
| 3,942,709 | 3/1976 | Gepfer | 229/15 |
| 4,621,764 | 11/1986 | Ragon | 229/15 |

*Primary Examiner*—Stephen Marcus
*Assistant Examiner*—Gary E. Elkins
*Attorney, Agent, or Firm*—Wood, Herron & Evans

[57] ABSTRACT

A partition assembly for dividing the internal space of a container comprising first and second sets of intersecting planar dividers, the sets of dividers having interengaging vertical slots which are locked at some or all of the points of intersection. The slots of the first set of dividers are defined by tabs cut from the first set of dividers and connected by vertical score lines to the first set of dividers. The vertical score lines of the first set of dividers are substantially colinear with the vertical slots of the second set of dividers. The tabs are folded along the score lines outwardly from the planes of the first set of dividers and into the planes of the second set of dividers and are permanently joined to the second set of dividers.

7 Claims, 1 Drawing Sheet

INTERIORLY LOCKED PARTITION ASSEMBLY

The present invention relates to partition assemblies, and more particularly, to partition assemblies having interfitting slotted dividers for dividing the space within a box, display, or container into a matrix of cells.

In the storage, shipment and display of parts and merchandise,it is very common for a single storage or display unit, such as a box, to be divided into a number of cells, each of which is intended to hold a separate item or items. The separation of the items which results from this division protects the items from damage and aids in the loading and unloading of thr boxes and in the maintenance of inventory. One of the most common examples of such division of boxes is in the matrix like partitioning of boxes for the storage and shipment of manufactured items.

This partitioning is commonly done with the use of dividers made of paperboard or plastic. A partition assembly is formed of two sets of slotted dividers, one longitudinally disposed in the box and the other transversely disposed so that the slots of the transversely disposed intersect with the slots in the longitudinally disposed dividers. In such a partition assembly, the dividers of one or both sets will have been slotted in such a way that the sets may be interfit to form a grid or an array to divide the space within the box orthogonally into a matrix of cells. These cells restrict the movement of the manufactured items to be protected in storage and in shipment, as well as providing for the easy packing and removal of the contents of the boxes.

Similar methods of partitioning are used for shipment of manufactured goods in returnable/reusable packaging programs. Commonly, such programs are utilized in shipping manufactured parts or goods from one source to another assembly source. After emptying of the manufactured goods from the partitioned container, the container, including the partition assembly, is generally collapsed and returned to the original manufacturer for refilling and reuse of the complete package. In the course of return of the package to the original manufacturer, the partition assembly is generally collapsed and returned in the collapsed condition, thereby enabling a greater quantity of shipping packages to be returned to the original manufacturer in a minimum of space.

When returnable/reusable slotted partition assemblies are utilized as part of a returnable/ reusable packaging program, the partitions are usually assembled in such a fashion that they may be removed from the box or container and collapsed without any tendency for the partition assembly to come apart or for the dividers to become separated. To that end, it has been common practice to fold over the endmost portion of one divider and to secure it or lock it to the side of the intersectiing divider or partition. Such a locked partition assembly is disclosed in U.S. Pat. No. 3,942, 709. This securement of the endmost portion of one divider to the side of an intersecting divider prevents the dividers of the partition assembly from coming separated when the assembly is withdrawn from the package and collapsed for shipment.

A problem is sometimes encountered with locked partition assemblies of the type described hereinabove wherein the endmost portion of the dividers are folded over and secured to the intersecting dividers, as in U.S. Pat. No. 3,942,709. The problem occurs because of the flexibility of the dividers. The problem is particularly acute in the case of short-height, long strip dividers. If the dividers are long and of short height, the dividers of the partition assembly can be easily pulled apart near the center of the partition assembly, even though the endmost portions of the dividers are still attached to the intersecting dividers. Once pulled apart, the dividers can be difficult to reasonable, and in any event, reassembly is a time-consuming operation which should preferably be avoided.

It has therefore been an objective of this invention to provide a construction of a returnable/ reusable partition assembly wherein some or all of the interior portion of the dividers, as well as the end portions, are securely locked against disassembly. This objective is achieved according to the practice of this invention by having the interior dividers of the partition assembly, as well as the endmost dividers, secured against disassembly.

According to the invention of this application, a partition assembly is provided in which the dividers are provided in intersecting longitudinal and transverse sets with the dividers of one set being slotted and interchangeable with slots of the other set. The interengaging vertical slots are locked at the point of intersection. Locking of the dividers at the points of intersection is effected by the slots of a first set of dividers being defined by a tab cut from the first set of dividers and connected by a vertical score line to the divider. The vertical score lines of the first set of dividers is substantially colinear with the vertical slots of the second set of dividers. The tabs are folded along the score lines from the plane of the first set of dividers and into the plane of the second set of dividers, and the tabs are permanently joined to the second set of dividers. In the preferred embodiment, the dividers are manufactured from plastic material, and the joining of the tabs of the first set of dividers to the dividers of the second set is effected by ultrasonic welding, thermal bonding, stapling, attaching with adhesives or some other bonding method. The dividers, though, could as well be manufactured from paperboard, in which event the tabs would generally be glued or adhesively secured or stapled to the intersecting dividers.

The advantage of the present invention is that it provides a simple and economical technique for securely locking the interior portions of the dividers of a partition assembly against disassembly. This technique is particularly advantageous for locking together long, flexible dividers of relatively short height.

In the practice of this invention, the slots of the first set of dividers are defined by the folded tabs. The tabs are formed by diagonal cuts extending from a top edge of the first set of dividers downwardly and diagonally until the cuts intersect the vertical score lines of the tabs. This construction of the slots is efficient and cost effective because it enables a single cut line and a score line to form a tab and slot without the need for multiple cuts and without the need to remove material from the dividers to form the slots.

These and other objects and advantages of this invention will be more readily apparent from the following description of the drawings in which.

Figure 1:
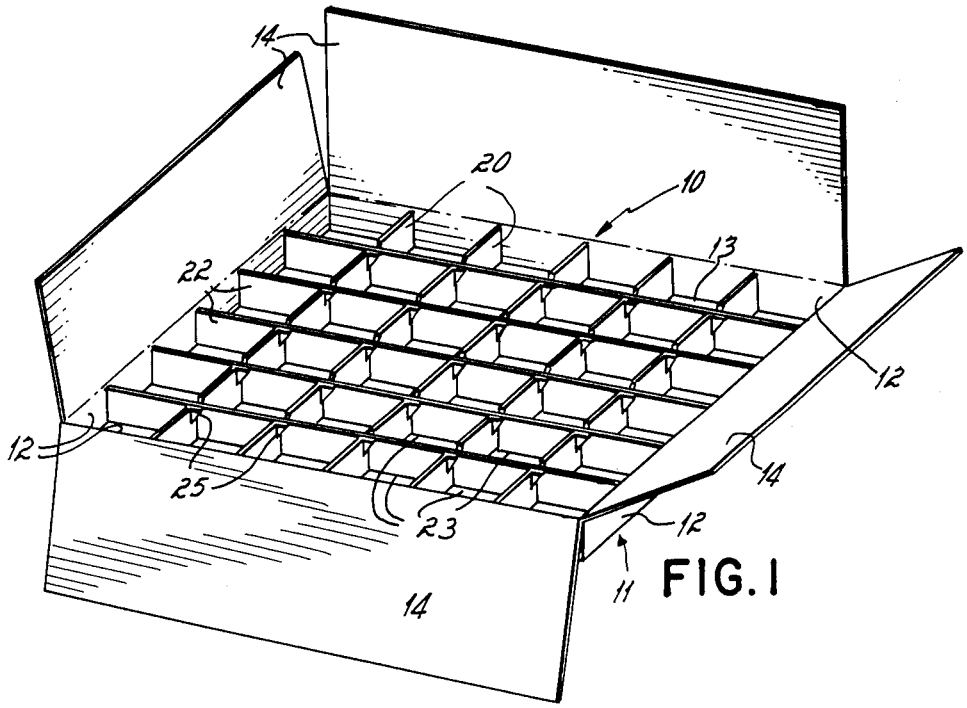
FIG. 1 is a perspective view of a partition assembly embodying the invention of this application wherein the partition assembly is illustrated as contained in a box.
Figure 2:
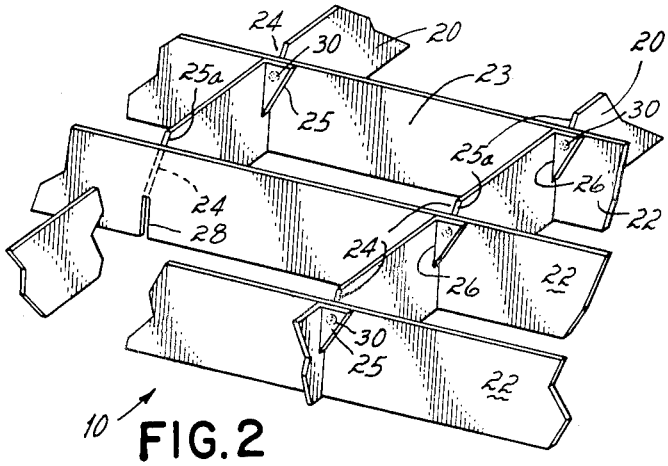
FIG. 2 is an enlarged perspective view, patially broken away, of a portion of the partition assembly of FIG. 1.
Figure 3:
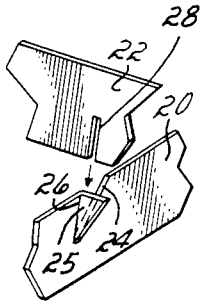
FIG. 3 is an exploded perspective view of one lock of the partition assembly of FIG. 1.
Figure 4:
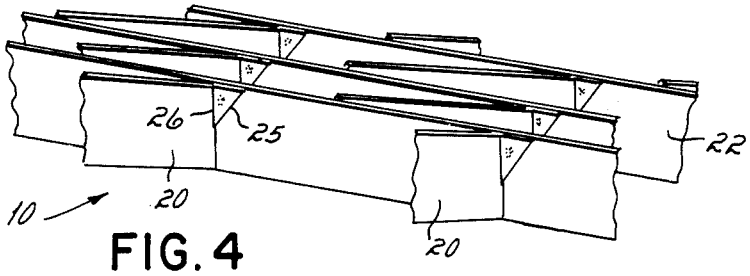
FIG. 4 is a perspective view of a portion of the partition assembly of FIG. 1, but illustrating the partition assembly in a partially collapsed condition.

With reference first to FIG. 1, there is illustrated a partition assembly 10 incorporating the invention of this application. This partition assembly is illustrated as being contained within a box 11. The box 11 comprises four side walls 12 and a bottom wall 13. Closure flaps 14 extend from the top edge of each of the four side wall of the box. The box 11 is conventional and per se forms no part of the invention of this application.

The partition assembly 10 includes a first set of longitudinal dividers 20 and a second set of transverse dividers 22, the dividers being arranged so that the sets intersect each other at right angles to divide the space within the box 11 into a matrix of cells 23.

The longitudinal dividers 20 each have a plurality of slots 24 extending from the top edge thereof downwardly to approximately the center of the divider 20. These slots 24 are defined by a tab 25 cut on a diagonal line 25*a* from the longitudinal divider and folded along a vertical score line 26 into a plane normal to the plane of the divider 22.

The transverse dividers 22 have a plurality of vertical slots 28 extending from the bottom edge of the dividers upwardly for approximately half the height of the divider. The longitudinal dividers 20 and the transverse dividers 22 are interfit during assembly such that the slots 24 of the longitudinal dividers 20 interchange the slots 28 of the transverse dividers to create a grid-like partition assembly.

It is to be noted that the slots 24 in the longitudinal dividers 20 are formed by the folded tabs 25, which tabs are folded so as to extend normal to the plane of the dividers 20 during assembly of the longitudinal dividers 20 with the transverse dividers 22. This technique of forming the slots 24 by means of a singular cut and score line, as opposed to two cuts and removal of scrap material from between the cuts, eliminates the scrap normally produced by conventional slots. Thereby, cost savings are realized.

In the preferred embodiment of the invention, both the longitudinal dividers 20 and the transverse dividers 22 are manufactured from plastic material, such as high density polyethylene. The material could as well, though, be paperboard or other material. This material is preferably die cut to the configuration illustrated in the drawings.

After assembly of the interengaging slots of the longitudinal dividers 20 and transverse dividers 22, the tabs 25 of the longitudinal dividers are welded as by spot welds 30 to the surface of the transverse dividers 2. Once these weldments of the dividers securely attach the longitudinal dividers to the transverse dividers, the resulting partition assembly is not subject to separation of all or any part of the assembled partition assembly. While in the preferred embodiment, the dividers are made of plastic material, and the dividers are secured together by welding of the tabs 25, the tabs could as well be secured to the dividers 22 by bonding, stapling, adhering or other conventional attachment techniques.

Prior to this invention, there has been a problem with divider assemblies, and particularly long, relatively short height divider assemblies separating at the center of the assembly. Once separated, it was often difficult to reassemble the partition assembly.

One common use for partition assemblies of the type described hereinabove is for use in reusable/returnable partition assemblies. Such assemblies are commonly used in boxes to ship parts from one manufacturer to an assembler. The boxes and partition assemblies are then returned to the manufacturer for reuse. During return, it is common practice to pull the partition assembly from the box, flatten the partition, collapse or nest the box and return the package in a collapsed nested condition to the manufacturer. Prior to this invention, though, there was a problem with the dividers of the partition assembly separating when they were removed from the box, even though the endmost partitions might have been secured to the intersecting partition assemblies in the manner illustrated in U.S. Pat. No. 3,942,709. The invention of this application, though, overcomes any tendency for the partition assembly to separate or to become disassembled.

While I have described only a single preferred embodiment of my invention, persons skilled in this art will appreciate changes and modifications which may be made without departing from the spirit of my invention. Therefore, I do not intend to be limited except by the scope of the following appended claims.

I claim:

1. a partition assembly for use in a container for dividing the internal space of the container, the partition assembly having a first planar divider extending in one direction and a second planar divider extending in a direction intersecting the first divider, the first divider and second divider having interengaging vertical slots which are locked at the point of intersection, the slot of the first divider being at least partially formed by a tab defined by a diagonal cut extending from a top edge of the first divider downwardly and diagonally to intersect a vertical score line connecting the tab to the first divider, said vertical score line of said divider being substantially colinear with the vertical slot of said second divider, said tab being folded along said score line away from the plane of said first divider and into the plane of said second divider, and the tab being permanently joined to the second divider.

2. The partition assembly of claim 1 wherein both said first and second dividers are manufactured from plastic materials.

3. The partition assembly of claim 1 wherein both said first and second dividers are manufactured from high density polyethylene.

4. The partition assembly of claim 3 wherein said tab is permanently joined to said second divider by welding.

5. A partition assembly for use in a container for dividing the internal space of the container, the partition assembly having a first set of planar dividers extending in one direction and a second set of planar dividers extending in a direction intersecting the first set of dividers, the first set of dividers and second set of dividers having interengaging vertical slots which are locked at the point of at least some of the intersections, the slots of the first set of dividers being at least partially formed by tabs defined by a diagonal cut extending from a top edge of the first set of dividers downwardly and diagonally to intersect vertical score lines connecting the tabs to the first set of dividers, said vertical score lines of said first set of dividers being substantially colinear with the vertical slots of the said second set of dividers, said tabs being folded along said score lines outwardly from the planes of said first set of dividers and into the planes of said second set of dividers, and the tabs being permanently joined to the second set of dividers.

6. The partition assembly of claim 5 wherein both said first and second sets of dividers are manufactured from plastic material.

7. The partition assembly of claim 5 wherein both said first and second sets of dividers are manufactured from high density polyethylene.

* * * * *